United States Patent [19]

Pawlicki et al.

[11] Patent Number: 4,583,734

[45] Date of Patent: Apr. 22, 1986

[54] RACKET HAVING A UNIQUE HANDLE STRUCTURE

[76] Inventors: Ulrich Pawlicki, Im Schellental 8; Wolfgang Schüler, An der Kopfbuche 20, both of D-5024 Pulheim, Fed. Rep. of Germany

[21] Appl. No.: 721,801

[22] Filed: Apr. 10, 1985

Related U.S. Application Data

[62] Division of Ser. No. 594,535, Mar. 29, 1984, Pat. No. 4,565,371.

[30] Foreign Application Priority Data

Apr. 9, 1983 [DE] Fed. Rep. of Germany ..... 3312834

[51] Int. Cl.[4] ..... A63B 49/08

[52] U.S. Cl. ..... 273/73 J

[58] Field of Search ..... 273/73 R, 73 J, 75, 273/67 R, 67 A, 76, 67 DB, 81 B, 73 C, 413, 414; D21/210, 211, 212, 213, 214; 43/18.1, 18.5

[56] References Cited

U.S. PATENT DOCUMENTS

| | | | |
|---|---|---|---|
| 3,246,894 | 4/1966 | Salisbury | 273/72 R |
| 4,221,383 | 9/1980 | Cappelli | 273/73 R X |
| 4,326,714 | 4/1982 | Novack | 273/73 C |

FOREIGN PATENT DOCUMENTS

| | | | |
|---|---|---|---|
| 827983 | 5/1938 | France | 273/73 J |
| 11067 | of 1912 | United Kingdom | 273/73 R |

*Primary Examiner*—Richard C. Pinkham
*Assistant Examiner*—Matthew L. Schneider
*Attorney, Agent, or Firm*—Spensley Horn Jubas & Lubitz

[57] ABSTRACT

A tennis racket having a head portion, handle portion and a shaft portion connecting the head portion to the handle portion. The shaft portion includes an arc which extends perpendicular to the plane defined by the head portion. Alternatively, a portion of the shaft has a thickness that is reduced in comparison to the rest of the shaft. In both embodiments, a filamentary traction element can be used to bridge the corresponding arc or reduced portion.

2 Claims, 4 Drawing Figures

FIG.1
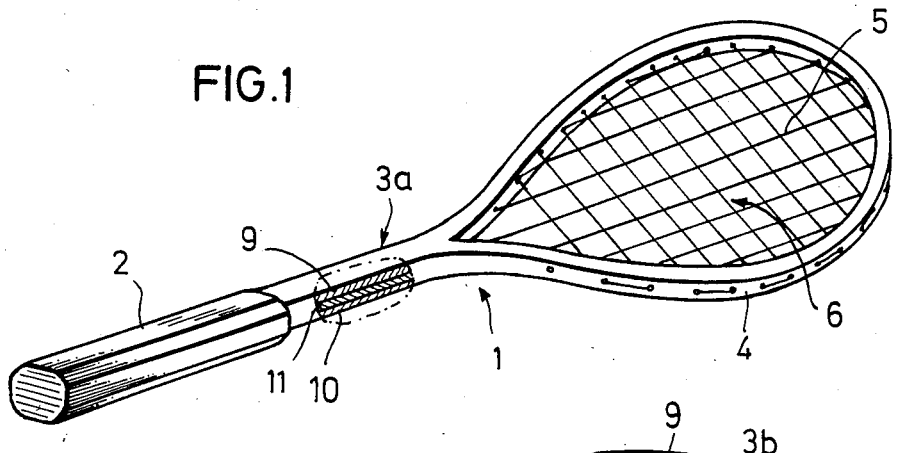
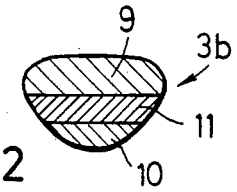
FIG.2
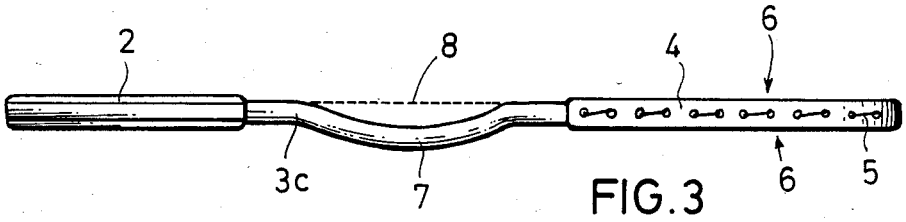
FIG.3
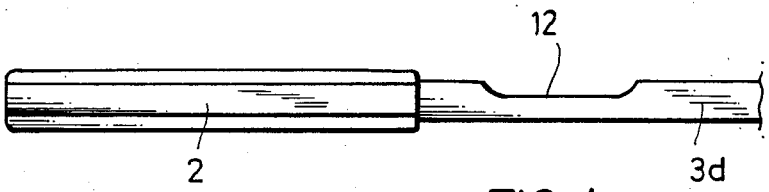
FIG.4

RACKET HAVING A UNIQUE HANDLE STRUCTURE

This is a division of application Ser. No. 06/594,535, filed on Mar. 29, 1984, now U.S. Pat. No. 4,565,371.

The invention relates to a game racket, in particular to a tennis racket comprising a hand grip portion, a handle and a head carrying strings which form a bilateral striking area.

In the known game racket, the head and the handle are made of wood, plastics or metal and of different combinations of said materials including different laminates. Subject to the material composition, different elastic properties of the game racket are realised in cooperation with the elastic properties of the strings. With a relatively inflexible game racket, in particular, a tennis racket, a so-called "hard" stroke with a high ball velocity is obtained by a corresponding striking force. On the other hand, relatively flexible tennis rackets are much better suited for returning "hard" strokes or shots at high ball velocities from the opponent. With a less flexible tennis racket, the arm is exposed to high shocks in case of exchanges of "hard" strokes which may result in an inflammation of the muscles generally known of as a "tennis arm".

It is the object of the invention to provide a game racket, in particular a tennis racket of the type mentioned above which permits execution of "hard" and "soft" strokes.

To solve said problem, the invention provides a handle which, transversely to the striking area has a higher flexibility or elasticity from the one side than from the other side.

A tennis ball may be struck by both sides of the striking area of the racket. Subject to the position taken by the tennis ball to be struck in relation to the player, there is a difference between a forehand and a backhand stroke which, unless the racket is twisted during the game, will always hit the same striking area side.

By means of the tennis racket of the invention, it is advantageously possible to perform e.g. a forehand stroke by always using the "harder" side of the racket, while the backhand stroke is made by using the "softer" side. This normally meets with the striking skill of the player who usually is a better forehand than backhand player. With a softer striking quality by the normally weaker backhand, it is possible to easily return "hard strokes" of the opponent on the backhand side.

On the other hand, by simply and quickly turning the racket through 180°, the striking property of the tennis racket can be altered in regard to the forehand or backhand. Thus, it is possible to quickly adapt oneself—even during the exchange of balls—to the playing style of the opponent and to catch a "hard" stroke in using the "soft" striking properties of one's own racket and vice versa. Thus, the playing possibilities in offensive or defensive matches are considerably enlarged for a tennis player. For instance a "hard" tennis racket which could presently be exchanged at the end of a match for a "softer" one by interfering in a complicated manner with the play of the event, will be now always available to the player.

Due to the invention, players having tennis arm inflammation need not rely on a "hard" tennis racket for an occasionally "hard" stroke in the course of the match.

At both sides of its central sectional plane parallel to the transverse axis of the striking area, the racket handle may substantially consist of materials having different elasticity properties. Moreover, the cross sectional shape of the handle may be different at both sides of said sectional plane.

Due to an asymmetric design of the handle concerning the construction and/or the material composition, in relation to a central sectional plane parallel to the transverse axis of the striking area, the transmission of the striking action on the hand grip portion is varied subject to the used side of the striking area.

The handle may be of a straight-lined design with the elastic properties resulting either from the use of different materials, from its cross sectional shape or both and involving the advantage that it does not look different from a conventional tennis racket, although it really displays the favorable properties of the invention.

In a preferred embodiment of the invention, the handle is curved outwardly relative to the striking area. A bent handle displays the favorable elastic property by its geometric shape so that different materials or asymmetric cross sectional forms need not be used. Moreover, from the direction of the arc, the player may tell at once which side of the racket has just been used in the match.

The quality of an outwardly arcuate handle shape may be also achieved in that the arc is left out in a straight-lined handle. In both cases, the arc of the handle may be bridged by a traction element or a shock absorber to support the desired properties of the handle.

With reference to the drawings, some embodiments of the invention will be explained hereinafter in more detail:

FIG. 1 is a perspective view of the tennis racket comprising a handle made of materials of a distinctive elasticity, FIG. 2 is a cross section of an asymmetric handle, FIG. 3 is a side view of an embodiment having a bent handle and a traction element bridging the arc, and FIG. 4 is an embodiment in which the arc is omitted in a straight-shaped handle.

The tennis racket 1 shown in FIG. 1 has a substantially octagonal handle grip portion 2. The handle portion 3*a* is cross-sectionally square for transmitting the movements imparted by the player to the handle 2 to a substantially oval head 4 provided with crossing and interlacing strings 5. At its end facing the head, the handle 3*a* is flared Y-wise in the striking area plane so that its contour is adapted tangentially to the oval outer contour of head 4. The strings 5 of the head 4 form a double-sided striking area 6 being substantially plane in the space enclosed by head 4.

Via the strings 5, the head 4 and the handle 3*a*, the shock-type stress caused by the impact of the tennis ball is transmitted by the striking area 6 to the handle grip portion 2. The handle portion 3*a* also serves for attenuating said forces and moments.

FIG. 1 shows a racket 1 having a handle 3*a* cut open longitudinally and consisting of three interconnected material layers 9,10,11 of distinctive elasticity properties which layers are superposed in longitudinal direction of the striking area plane. It is also possible to use two materials only.

The striking properties of the tennis racket are dictated by the geometric arrangement and by the elastic properties as well as by the proportions of the used materials 9,10,11. Thus, as compared to material 10 or 10,11, material 9 may form only a thin marginal layer.

Preferably, the materials used are wood, plastics or metal as well as combinations and laminates thereof, the meaning of different materials also includes laminates of the same materials but of different thicknesses.

A different elastic behavior of the handle 3*b* may be also realised by its asymmetric or semisymmetric cross sectional shape such as illustrated in FIG. 2, which may be still supported by using different materials 9,10,11 in the cross sectional direction.

FIG. 3 shows a side view of a tennis racket 1 to illustrate that the elastic properties may be obtained by the shape of the handle 3*c* by designing it as an arc 7 which may be bridged additionally by a traction element 8 which may be a filamentary or band shaped flat structure preferably of a high tensile strength.

FIG. 4 shows another embodiment omitting the arc 12 in the straight-shaped handle 3*d*. Instead, the handle has a portion 12 that is reduced in thickness and this portion 12 may be bridged by a traction element or by a shock absorber.

The constructional features of the embodiments according to FIGS. 1 to 4 may be optionally interchanged or combined to obtain the desired elastic properties of the tennis racket.

What is claimed is:

1. A game racket comprising a head portion, a handle shaft portion and a handle grip portion, said handle shaft portion connecting said head portion to said handle grip portion, said head portion defining an area which has strung thereacross a plurality of strings forming a bilateral striking area, part of said handle shaft portion being curved in a direction perpendicular to the plane of said striking area, said curved part of said handle shaft portion being bridged by a traction element, and wherein said traction element is a filamentary structure.

2. A game racket comprising:

a head portion, a handle shaft portion, a handle grip portion, said handle shaft portion connecting said head portion to said handle grip portion, said head portion defining an area which has strung thereacross a plurality of strings forming a bilateral striking area, said handle shaft portion forming an arc perpendicular to the striking area, said racket having asymmetric striking characteristics, a tension element bridging said arc, and wherein said tension element is a filamentary structure.

* * * * *